US008490523B2

(12) United States Patent
Tsai et al.

(10) Patent No.: US 8,490,523 B2
(45) Date of Patent: Jul. 23, 2013

(54) LOCKABLE FOLDING MULTI-TOOL

(75) Inventors: Kevin Tsai, Taichung (TW); Thomas Pelletier, Wallingford, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 382 days.

(21) Appl. No.: 12/789,200

(22) Filed: May 27, 2010

(65) Prior Publication Data

US 2011/0289693 A1 Dec. 1, 2011

(51) Int. Cl.

| | |
|---|---|
| ***B25B 23/00*** | (2006.01) |
| ***B26B 11/00*** | (2006.01) |
| ***B25F 1/04*** | (2006.01) |

(52) U.S. Cl.

USPC ..... 81/440; 7/118; 7/168; 81/439; 81/177.4

(58) Field of Classification Search

USPC ..... 81/440, 436, 439, 177.4; 7/118, 7/138, 165, 168

See application file for complete search history.

(56) References Cited

U.S. PATENT DOCUMENTS

| | | | | |
|---|---|---|---|---|
| 3,943,801 | A | 3/1976 | Yates | 81/440 |
| 5,320,004 | A | 6/1994 | Hsiao | 81/440 |
| 5,450,774 | A | 9/1995 | Chang | 81/440 |
| 5,495,942 | A | 3/1996 | Izhak | 206/372 |
| 5,581,834 | A | 12/1996 | Collins | 7/118 |
| 6,079,301 | A | 6/2000 | Scolo | 81/177.6 |
| 6,088,860 | A | 7/2000 | Poehlmann et al. | 7/128 |
| 6,088,861 | A | 7/2000 | Sessions et al. | 7/128 |
| 6,092,444 | A | 7/2000 | Hsiao | 81/440 |
| 6,128,981 | A | 10/2000 | Bondhus et al. | 81/440 |
| 6,151,999 | A | 11/2000 | Eklind | 81/440 |
| 6,397,709 | B1 * | 6/2002 | Wall | 81/440 |
| 6,510,767 | B1 | 1/2003 | Rivera | 81/440 |
| 6,601,481 | B2 | 8/2003 | Chuang | 81/440 |
| 6,779,425 | B2 | 8/2004 | Ackeret et al. | 81/440 |
| 6,845,535 | B2 | 1/2005 | Phelps | 7/118 |
| 6,868,760 | B1 | 3/2005 | Johnson | 81/440 |
| 6,880,435 | B2 | 4/2005 | Hawkins | 81/440 |
| 6,935,212 | B2 | 8/2005 | Wadsworth | 81/60 |
| 6,948,409 | B2 | 9/2005 | Ackeret et al. | 81/440 |
| 7,124,458 | B2 | 10/2006 | Phelps | 7/118 |
| 7,281,456 | B2 | 10/2007 | Chiang | 81/440 |
| 7,334,508 | B2 | 2/2008 | Heaven | 81/440 |
| 7,383,755 | B1 * | 6/2008 | Kang | 81/440 |
| 7,480,997 | B2 | 1/2009 | Ping | |
| 7,481,137 | B1 | 1/2009 | Johnson | 81/440 |
| D632,155 | S * | 2/2011 | Lai | D8/107 |
| 2006/0260138 | A1 | 11/2006 | VanHoy | 30/161 |
| 2007/0221017 | A1 | 9/2007 | Heaven | 81/440 |
| 2007/0245570 | A1 | 10/2007 | Tsuda | 30/161 |

* cited by examiner

*Primary Examiner* — Hadi Shakeri
(74) *Attorney, Agent, or Firm* — Pillsbury Winthrop Shaw Pittman LLP

(57) ABSTRACT

A locking folding tool is disclosed. The folding tool comprises a housing having a pair of sidewalls in spaced relation to each other, and a support extending transversely between the pair of sidewalls. The folding tool may further have a plurality of work tools pivotally supported by the support. As such, the support may define a pivot axis for the work tools. Each work tool may further have an associated lock engaging member. The folding tool may also include a lock member movable between a first position and a second position. When the lock member is in the first position, it may engage the lock engaging members so that each of the work tools is inhibited from pivoting about the support. When the lock member is in the second position, it may disengage the lock engaging member so that the work tools are pivotable about the support.

31 Claims, 8 Drawing Sheets

LOCKABLE FOLDING MULTI-TOOL

FIELD OF THE INVENTION

The present invention relates generally to tools comprising a plurality of work tools configured to unfold from a housing.

BACKGROUND OF THE INVENTION

Foldable "multi-tools" are used to contain a plurality of tools in a single housing. Among other things, the present application relates to a plurality of folding tools having a locking mechanism to hold each of the plurality of tools in an extended or stored position.

SUMMARY OF THE INVENTION

According to one aspect of this disclosure, a folding tool comprises a housing having a pair of sidewalls in spaced relation to each other. A support may extend transversely between the sidewalls of the housing. The folding tool may further have a plurality of work tools pivotally supported by the support, whereby the support defines a pivot axis for the work tools. Associated with each work tool may be an associated lock engaging member. The tool may further comprise a lock member movable between a first position and a second position. When the lock member is in the first position, it may engage the lock engaging members so that the work tools are inhibited from pivoting about the support. When the lock member is in the second position, it may disengage the lock engaging members so that each of the work tools is pivotable about the support. In such a folding tool, the lock member may be configured to not apply an axial force to the lock engaging members.

Another aspect of this disclosure relates to a folding tool comprising a housing having a pair of sidewalls in spaced relation to each other. A support may extend transversely between the sidewalls of the housing. The folding tool may further have a plurality of work tools pivotally supported by the support, whereby the support defines a pivot axis for the work tools. Associated with each work tool may be an associated lock engaging member. The tool may further comprise a lock member movable between a first position and a second position. When the lock member is in the first position, it may engage the lock engaging members so that the work tools are inhibited from pivoting about the support. When the lock member is in the second position, it may disengage the lock engaging members so that each of the work tools is pivotable about the support. In such a folding tool, the lock member may be configured to be axially movable about an axis that is spaced from the pivot axis.

Another aspect of this disclosure relates to a folding tool comprising a housing having a pair of sidewalls in spaced relation to each other. A support may extend transversely between the sidewalls of the housing. The folding tool may further have a plurality of work tools pivotally supported by the support, whereby the support defines a pivot axis for the work tools. Associated with each work tool may be an associated lock engaging member. The tool may further comprise a lock member movable between a first position and a second position. When the lock member is in the first position, it may engage the lock engaging members so that the work tools are inhibited from pivoting about the support. When the lock member is in the second position, it may disengage the lock engaging members so that each of the work tools is pivotable about the support. In such a folding tool, an axial force applied to the work tools may be substantially constant regardless of whether the lock member is in the first position or the second position.

Another aspect of this disclosure relates to a folding tool comprising a housing having a pair of sidewalls in spaced relation to each other. A support may extend transversely between the sidewalls of the housing. The folding tool may further have a plurality of work tools pivotally supported by the support, whereby the support defines a pivot axis for the work tools. The folding tool may further have a lock assembly configured to selectively lock the plurality of work tools at a plurality of angles with respect to the housing. The folding tool may further comprise a stop arrangement establishing a plurality of minimum angles that the plurality of work tools may form with the housing at the support.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not a limitation of the invention. In addition, it should be appreciated that structural features shown or described in any one embodiment herein can be used in other embodiments as well. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

Features of the tool in accordance with one embodiment are shown in the drawings, in which like reference numerals designate like elements. The drawings form part of this original disclosure in which.

DETAILED DESCRIPTION OF THE ILLUSTRATED EMBODIMENTS)

Figure 1:
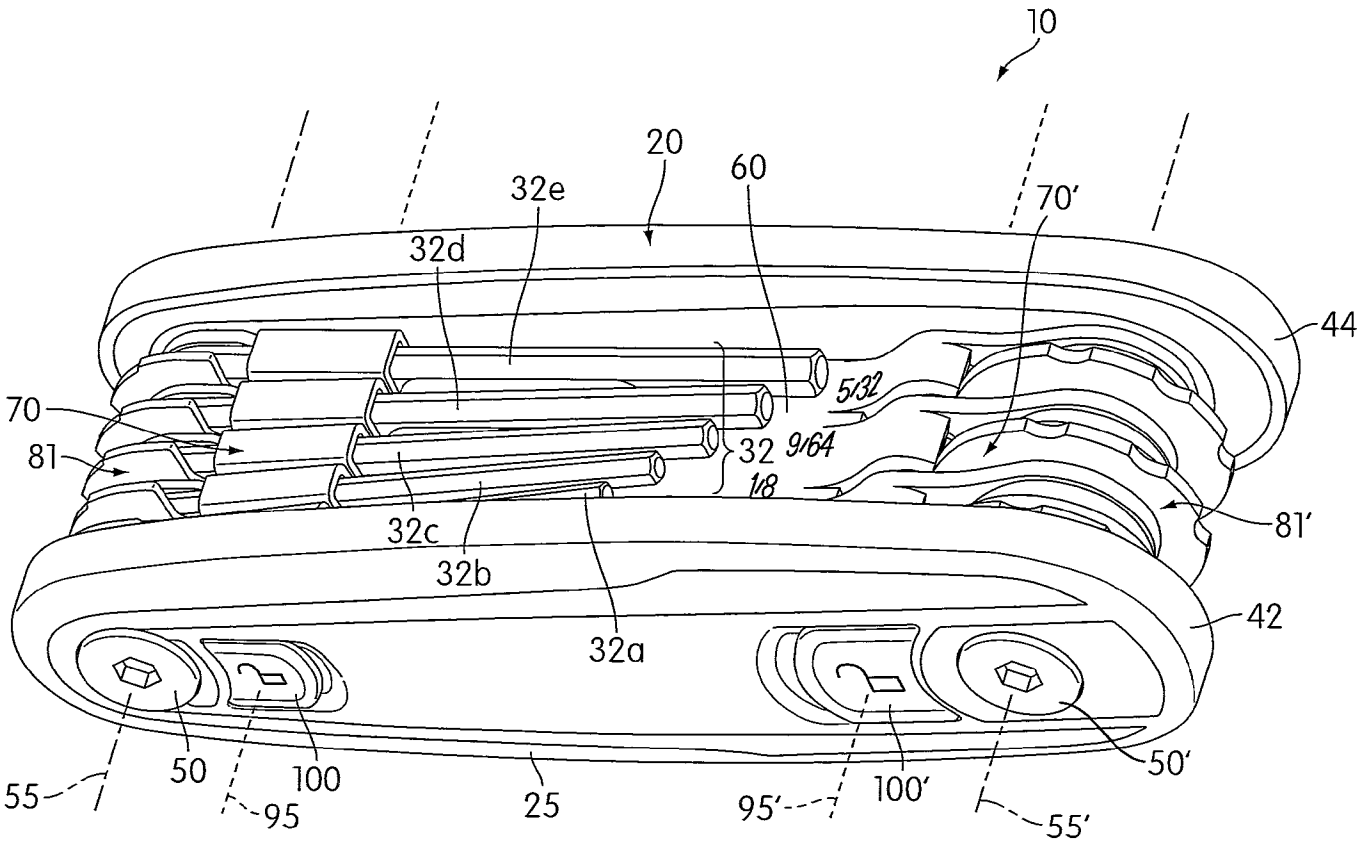
FIG. 1 is a perspective view of an embodiment of the folding tool of the present invention.

FIG. 1 shows an embodiment of a folding tool 10 of the present invention. The folding tool 10 comprises a housing 20 configured to hold a first plurality of work tools 32. The first plurality of work tools 32 will be discussed in greater detail below. The housing 20 may be of any suitable construction or configuration, including but not limited to metal, plastic, elastomer, wood or combinations thereof. In an embodiment, the housing 20 may be at least partially wrapped in a grip material 25, including but not limited to rubber. The housing 20 may have an elongated appearance, and in an embodiment may be hinged, for example to unfold to expose one or more tools, such as a pair of pliers, knives, screwdrivers, saws, scissors, or other tools concealed therein. In the illustrated embodiments, the housing 20 comprises a first sidewall 42 and a second sidewall 44 in spaced relation to one another. In an embodiment, the housing 20, including the first and second sidewalls 42 and 44 may be constructed to comfortably fit in the palm of a user's hand. In an embodiment, the grip material 25 may at least partially wrap or cover the first and second sidewalls 42 and 44. In an embodiment, the housing 20, including the first and second sidewalls 42 and 44, may include branding information, and may be colored to correspond to a brand's trade dress.

Extending transversely between the first and second sidewalls 42 and 44 of the folding tool 10 is at least a first support 50. In an embodiment, such as the illustrated embodiment, the folding tool 10 may further comprise at least a second support 50'. In an embodiment, the first support 50 may be configured to define a first pivot axis 55 for the first plurality of work tools 32. In embodiments with the second support 50', the second support 50' may be configured to define a second pivot axis 55' for a second plurality of work tools 32' (obscured in FIG. 1). In an embodiment, each of the first and second supports 50 and 50' may comprise a bar, pin, screw or bolt, extending along their respective pivot axes 55 or 55' from the first side wall 42, through a portion of each of the first and second pluralities of work tools 32 and 32' and associated components, to the second sidewall 44. In an embodiment, first and second sidewalls 42 and 44 may also be separated by a separator 60, which may generally extend between and substantially perpendicular to the orientation of the first and second sidewalls 42 and 44. In an embodiment, the separator 60 may generally be framed by the first and second sidewalls 42 and 44, and the supports 50 and 50', as will be discussed in greater detail below.

The folding tool 10 may further comprise a first lock assembly 70 (discussed below and unobscured in FIG. 8), which may be associated with the support 50, and configured to selectively lock the first plurality of work tools 32 in different preset angles with respect to the housing 20. As seen in the illustrated embodiment, the folding tool 10 may also comprise a second lock assembly 70' (similar to the first lock assembly 70 unobscured in FIG. 8), associated with the second support 50', and configured to selectively lock the second plurality of work tools 32' in different preset angles with respect to the housing 20. The first and second lock assemblies 70 and 70' may comprise a first and second plurality of lock engaging members 81 and 81', each of which is associated with one of the first and second pluralities of work tools 32 and 32'. For example, in the illustrated embodiments, each of the first plurality of lock engaging members 81 are associated with one of the first plurality of work tools 32, and each of the second plurality of lock engaging members 81', are associated with one of the second plurality of work tools 32'. In an embodiment, each of the first set of lock engaging members 81 may be configured to selectively engage with a first lock member 90 (obscured in FIG. 1) that is positioned along a first lock axis 95. Likewise, each of the second set of lock engaging members 81' may be configured to selectively engage with a second lock member 90' that is positioned along a second lock axis 95'. Both the first and second set of lock engaging members 81 and 81' and the first and second lock members 90 and 90' are described in greater detail below. As is seen in the non-limiting embodiment of FIG. 1, the selective engagement of the first lock member 90 may be actuated through a first push button 100 that may be built into one or both of the first and second sidewalls 42 and 44. Also seen is that the selective release of the second lock member 90' may be actuated through a second push button 100' that may also be built into one or both of the first and second sidewalls 42 and 44.

Figure 2:
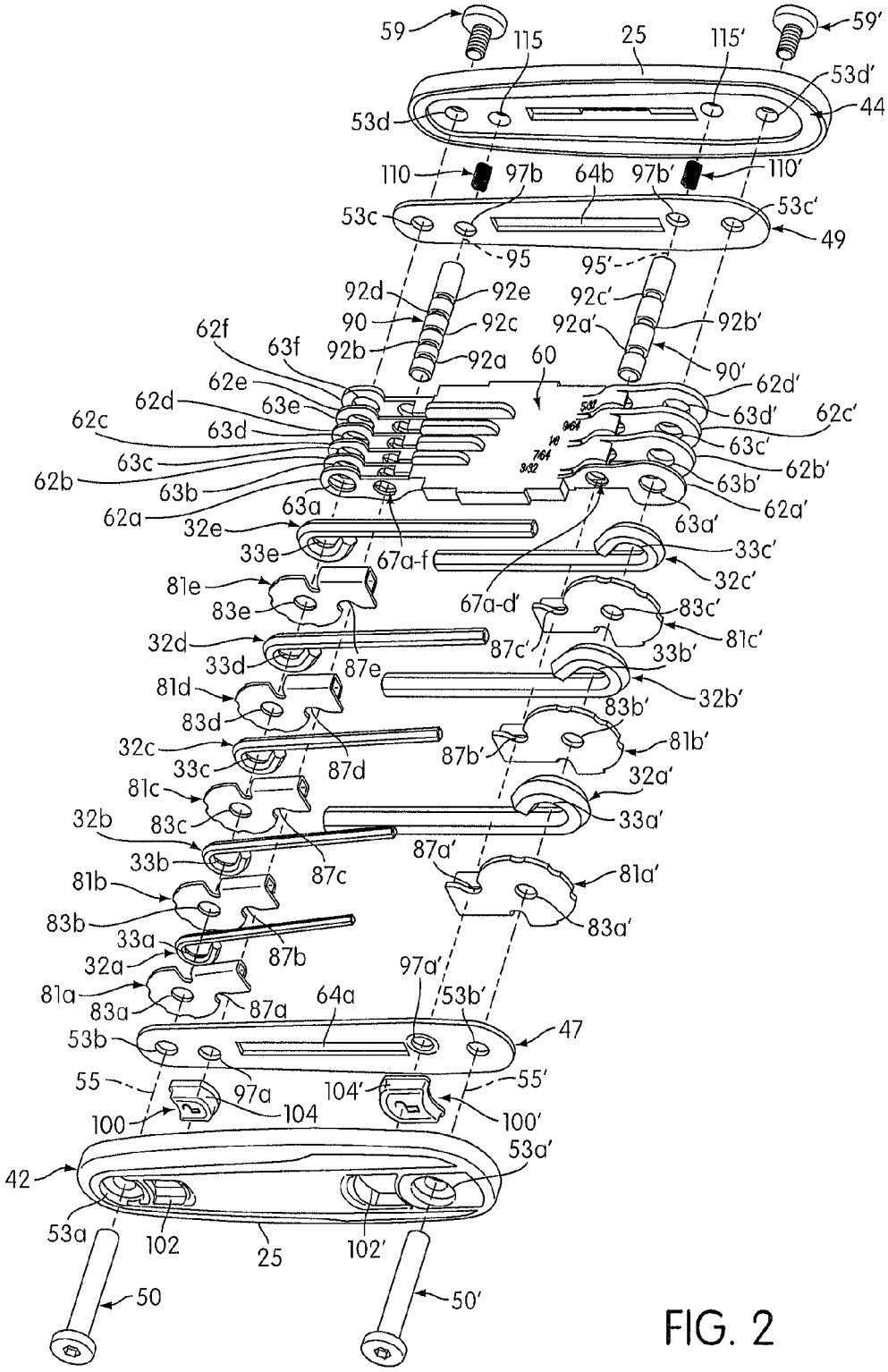
FIG. 2 shows an exploded view of the embodiment of FIG. 1, showing the constituent components thereof.

Turning now to FIG. 2, the assembly of all components of the illustrated embodiment of the folding tool 10 can be seen in exploded form. Shown are the first and second sidewalls 42 and 44, including the first sidewall 42 and the second sidewall 44. The first and second sidewalls 42 and 44 are partially covered in the grip material 25. Also seen are a first interior sidewall 47 associated with the first sidewall 42, and a second interior sidewall 49 associated with the second sidewall 44. Located between the first sidewall 42 and the first interior sidewall 47 are the first and second push buttons 100 and 100', each of which may be configured to be received by a corresponding first and second opening 102 and 102' in the first sidewall 42. The first and second push buttons 100 and 100' may be prevented from completely passing through the corresponding first and second openings 102 and 102' due to a first and second outwardly projecting lip 104 and 104' on the first and second push buttons 100 and 100'. The first and second raised lips 104 and 104' may be configured as stepped portions that provide a planar area larger than the size of the corresponding openings 102 and 102' on the first sidewall 42. The first interior sidewall 47 may limit the maximal depression that the first and second push buttons 100 and 100' may be depressed, as will be discussed in greater detail below.

Located between the first and second sidewalls 42 and 44 of the folding tool 10 is the separator 60. The separator 60 may be of any suitable construction or configuration, including but not limited to metal, plastic, wood, or combinations thereof. The separator 60 may provide a surface against which the first and second plurality of work tools 32 and 32' may pivot into when the folding tool 10 is in its closed position. From the perspective shown in FIG. 2, the first plurality of work tools 32 are positioned to contact the visible side of the separator 60 when in their closed positions. On the other hand the second plurality of work tools 32' in the illustrated embodiment are configured to contact the obscured side of the separator 60 when in their closed positions.

In the illustrated embodiment, the separator 60 comprises a plurality of first support engaging portions 62 and a plurality of second support engaging portions 62', which extend outward from the center of the separator 60. In an embodiment wherein the separator 60 engages the first and second sidewalls 42 and 44, a portion of the separator 60 may pass through a receiving hole **64*a* in the first interior sidewall 47, and a receiving hole 64*b* in the second interior sidewall 49. Further details of the structure of the separator 60** are discussed below.

Also seen in FIG. 2 are the first and second sets of work tools 32 and 32', and their associated first and second sets of lock engaging members 82 and 82'. As can be seen in the illustrated embodiment, on the left side of FIG. 2 are five of the work tools 32*a-e* configured to pivot about the first support 50 upward from the separator 60 in the view shown. On the right side of FIG. 2 are three work tools 32*a*'-c' configured to pivot about the second support 50' downward from the separator 60 in the perspective of the view shown. In various embodiments, the number and type of work tools 32' configured to pivot about each support 50 or 50' may vary. As seen in the illustrated embodiment, the first and second sets of folding tools 32*a-e* and 32*a*'-c' may be hex keys of differing sizes. In the illustrated embodiment, wherein the separator 60 comprises the first support engaging portions 62, each of the first plurality of work tools 32*a-e* and their associated first set of lock engaging members 81*a-e* may be interspersed between each of the first support engaging portions 62, such as support engaging portions 62*a-f*. For example, work tool 32*a* and associated lock engaging member 81*a* may be located between a first support engaging portion 62*a* and a first support engaging portion 62*b*. Likewise, in embodiments wherein the separator 60 comprises the second support engaging portions 62', such as support engaging portions 62*a*'-d', each of the second plurality of work tools 32' and their associated second set of lock engaging members 81' may be interspersed between each of the second support engaging portions 62*a*'-d'. For example, work tool 32*a*' and associated lock engaging member 81*a*' may be located between second support engaging portion 62*a*' and second support engaging portion 62*b'*.

Also visible in FIG. 2 are the first lock member 90 and the second lock member 90'. The first and second lock members 90 and 90' comprise a respective first and second plurality of circumferential grooves 92 and 92' that correspond to the first and second sets of lock engaging members 81 and 81'. For example, first circumferential grooves 92*a*, 92*b*, 92*c*, 92*d*, and 92*e* correspond with first lock engaging members 81*a*, 81*b*, 81*c*, 81*d*, and 81*e* respectively. Likewise, second circumferential groove 92*a*', 92*b*', and 92*c*' correspond with second lock engaging members 81*a*', 81*b*', and 81*c*' respectfully, as will be discussed in greater detail below.

As seen in the illustrated embodiment, the first and second lock members 90 and 90' are axially moveable along the respective first and second lock axes 95 and 95'. In an embodiment, the movement of the first and second lock members 90 and 90' may be between a first position and a second position. As seen, the first lock member 90 may terminate at one end by the first sidewall 42 at the first push button 100, and on the other end by the second sidewall 44 at a first bias member 110. Likewise, the second lock member 90' terminates at one end by the first sidewall 41 at the second push button 100, and on the other end by the second sidewall 44 at a second bias member 110'. In an embodiment, the first and second bias members 110 and 110' may be configured to bias their respective lock members 90 and 90' to the first position, which may correspond to a locking of the first and second pluralities of work tools 32 and 32'. In an embodiment, the first and second bias members 110 and 110' may be configured to bias the raised lips 104 and 104' of their respective push buttons 100 and 100' against the contacting portion of their corresponding openings 102 and 102'. The bias members 110 and 110' can be of any construction or configuration, including but not limited to metal and/or plastic. In an embodiment, each of the bias members 110 and 110' may comprise a spring.

In an embodiment, the first and second bias members 110 and 110' may be received by corresponding first and second bias member receptacles 115 and 115', which, in an embodiment, may be located in the second sidewall 44 at the intersection of the second sidewall 44 and the first and second lock axes 95 and 95'. In an embodiment, pressing either of the push buttons 100 or 100' may cause a compression of their associated first or second bias members 110 or 110'. In such an embodiment, by pressing on the first or second push buttons 100 or 100', their associated first or second lock member 90 or 90' may move from their first position, against the bias, to a second position that corresponds to an unlocking of the first and second pluralities of work tools 32 and 32'. In an embodiment, the second position may correspond with a maximal depression of the push button 100 or 100'. In an embodiment, the maximal depression of the push button 100 or 100' may be fixed by the compression of the bias member 110 or 110', by contact between the push button 100 or 100' and the first interior sidewall 47, or by any other structure.

During assembly of the folding tool 10 in the illustrated embodiment, the first support 50 may enter a plurality of receiving holes arranged along the components of the folding tool 10 that are supported by or pivot about the pivot axis 55. For example, in the illustrated embodiment, the support 50 would enter a receiving hole 53*a* located on the first sidewall 42, a receiving hole 53*b* located on the first interior sidewall 47. The support 50 would then enter a receiving hole 83 on each lock engaging member 81 and an associated receiving hole 33 on each work tool 32. In embodiments wherein the first plurality of work tools 32 and associated first set of lock engaging members 81 are interspersed between the plurality of support engaging portions 62 on the separator 60, the support 50 may also enter an associated receiving hole 63 on each support engaging portion 62. As seen in FIG. 2, the support would enter receiving holes 53*a*, 53*b*, 63*a*, 83*a*, 33*a*, 63*b*, 83*b*, 33*b*, 63*c*, 83*c*, 33*c*, 63*d*, 83*d*, 33*d*, 63*e*, 83*e*, 33*e*, and 63*f*. The support would then enter a receiving hole 53*c* located on the second interior sidewall 49 and a receiving hole 53*d* located on the second sidewall 44 before encountering a support receiving piece 59. Such a configuration may also be true for the components of the folding tool 10 configured to pivot around the second support 50'. For example, as also seen in FIG. 2, the support would enter corresponding second receiving holes 53*a*', 53*b*', 63*a*', 83*a*', 33*a*', 63*b*', 83*b*', 33*b*', 63*c*', 83*c*', 33*c*', and 63*d*', before entering receiving holes 53*c*' and 53*d*', before encountering a second support receiving piece 59'. In an embodiment, any "receiving hole" may not be circumferentially surrounded, but may instead comprise any open space or notch through which another body may pass therein. In an embodiment the first and second supports 50 and 50', and corresponding first and second support receiving pieces 59 and 59' may be configured to have corresponding threaded fasteners, allowing securement of the supports 50 and 50' to the support receiving pieces 59 and 59'.

During assembly of the folding tool 10, the first and second lock members 90 and 90' may also be inserted inside the housing 20 and, as noted, may terminate at either end by the push buttons 100 and 100', and the bias members 110 and 110'. To terminate at these components, portions of the first and second lock members 90 and 90' may pass through the first interior sidewall 47 and the second interior sidewall 49. In an embodiment, the first interior sidewall 47 may comprise a receiving hole 97*a* configured to receive a portion of the first lock member 90 that will contact the first push button 100, as well as a second receiving hole 97*a*' configured to receive a portion of the second lock member 90' that will contact the second push button 100'. On the other ends of first and second lock members 90 and 90', there may be first and second receiving holes 97*b* and 97*b*' configured to receive portions of the first and second lock members 90 and 90' that will contact the bias members 110 and 110' that are received within first and second bias member receptacles 115 and 115' on the second sidewall 44. In embodiments wherein the plate 60 comprises first support engaging portions 62, such as support engaging portions 62*a-f*, the first support engaging portion 62*a-f* may comprise corresponding receiving holes 67, such as receiving holes 67*a-f* for the first lock member 90. Likewise, in embodiments wherein the plate 60 comprises second support engaging portions 62', such as support engaging portions 62*a*'-d', the second support engaging portion 62*a*'-d' may comprise corresponding receiving holes 67', such as receiving holes 67*a*'-d' for the second lock member 90'. Additionally, each of the first and second lock engaging members 81*a-f* and 81*a*'-c' may have corresponding indentations 87, such as 87*a-e* and 87*a*'-c' (generically 87*n*), that may be configured to interact with the first and second lock members 90 and 90' when the associated work tools 81*a-e* and 81*a*'-c' are in their stored position, as will be described in greater detail below.

Figure 3:
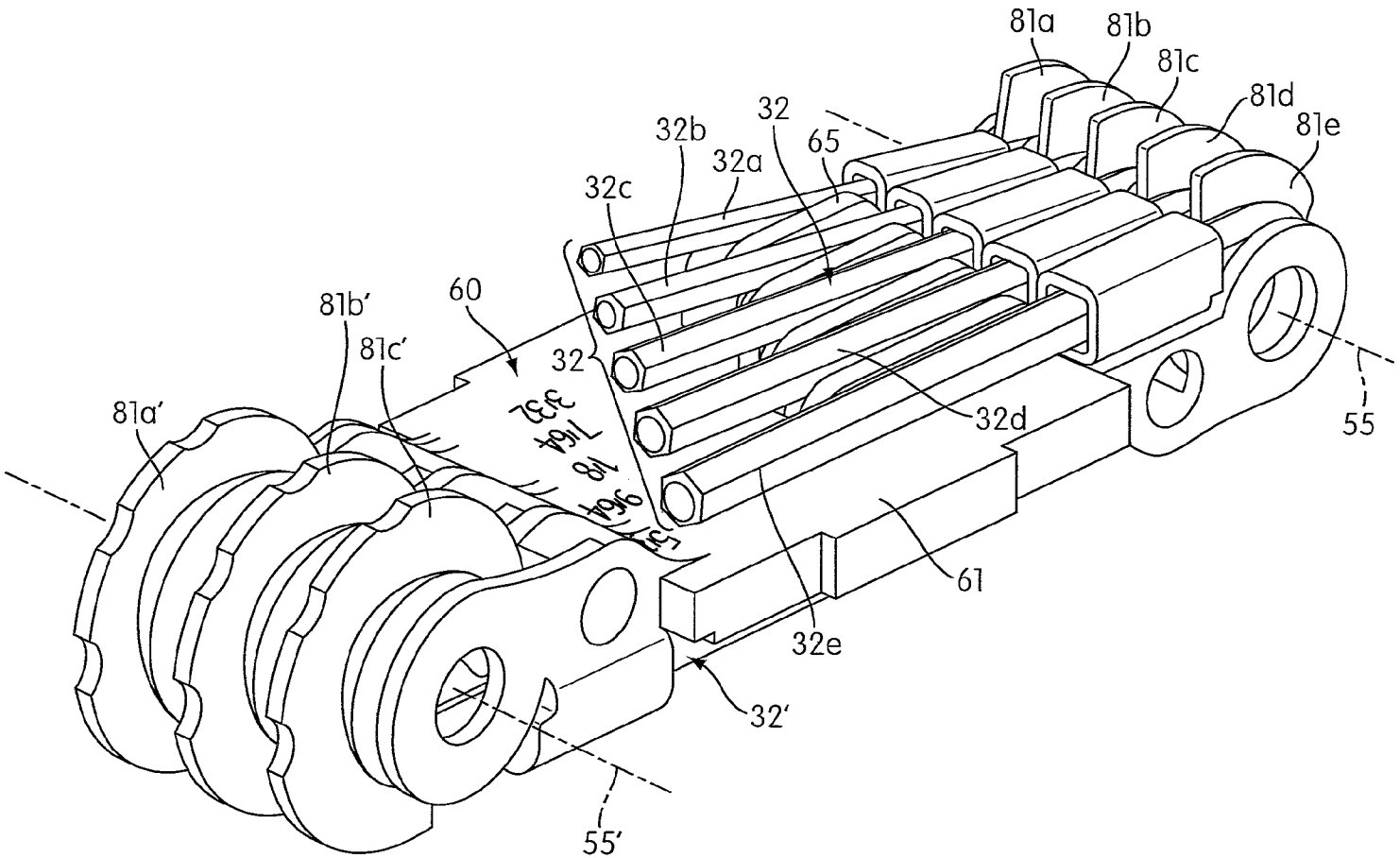
FIG. 3 is an isolated perspective view of a portion of the embodiment of FIG. 1, showing a plurality of work tools and associated lock engaging members, interacting with a separator and associated tapered body.

As seen in the view of FIG. 3, the separator 60 may separate the first plurality of work tools 32 from the second plurality of work tools 32' In an embodiment, the separator 60 may be configured to limit the range of pivotal motion of the first and second pluralities of work tools 32 and 32'. In an embodiment, the separator 60 may comprise a stop arrangement, providing points of contact for the first and second plurality work tools 32 and 32' to pivot into when the folding tool 10 is in its closed position. The stop arrangement may be of any suitable configuration, including but not limited to one or more pins, bars, or other structure or series of structures immovably residing within a portion of the range of motion of the first and second pluralities of work tools 32 and 32' around the pivot axes 55 and 55', thus interfering with the pivotal motion of the first and second pluralities of work tools 32 and 32' in a given direction around the supports 50 and 50'. For example, the separator 60 may accomplish this by having a main separator body 61 located at least partially in the range of motion of the first and second pluralities of work tools 32 and 32'. As seen in the illustrated embodiment, the separator 60 may also be configured to taper the closed positions of some of the first and second pluralities of work tools 32 and 32', for example by having a tapered body 65 that exists on the main separator body 61, so that when each of the plurality of work tools are placed in their closed position (i.e. are stored within the housing 20), they contact an associated portion of the tapered body 65, which may prevent some of the first and second pluralities of work tools 32 and 32' from coming into contact with the main separator body 61. In an embodiment, the tapered body 65 may establish a different minimum angle for each of the first and second pluralities of work tools 32 and 32' with respect to the main separator body 61 when the first and second pluralities of work tools 32 and 32' are in their closed position. Such a configuration may be useful, for example, to facilitate a user's selectively grasping one of the first and second pluralities of work tools 32 and 32'. In an embodiment, wherein the first and second pluralities of work tools 32 and 32' are of a progressively increasing size both in cross section and in length, the tapered body 65 may be configured to lift the shorter and smaller of the first and second pluralities of work tools 32 and 32' (i.e. work tool 32*a* of the first plurality of work tools 32) to a greater nonzero angle with respect to the main separator body 61 than the longer and larger of the first and second pluralities of work tools 32 and 32' (i.e. work tool 32*e* of the first plurality of work tools 32), as is shown in FIG. 3.

Figure 4:
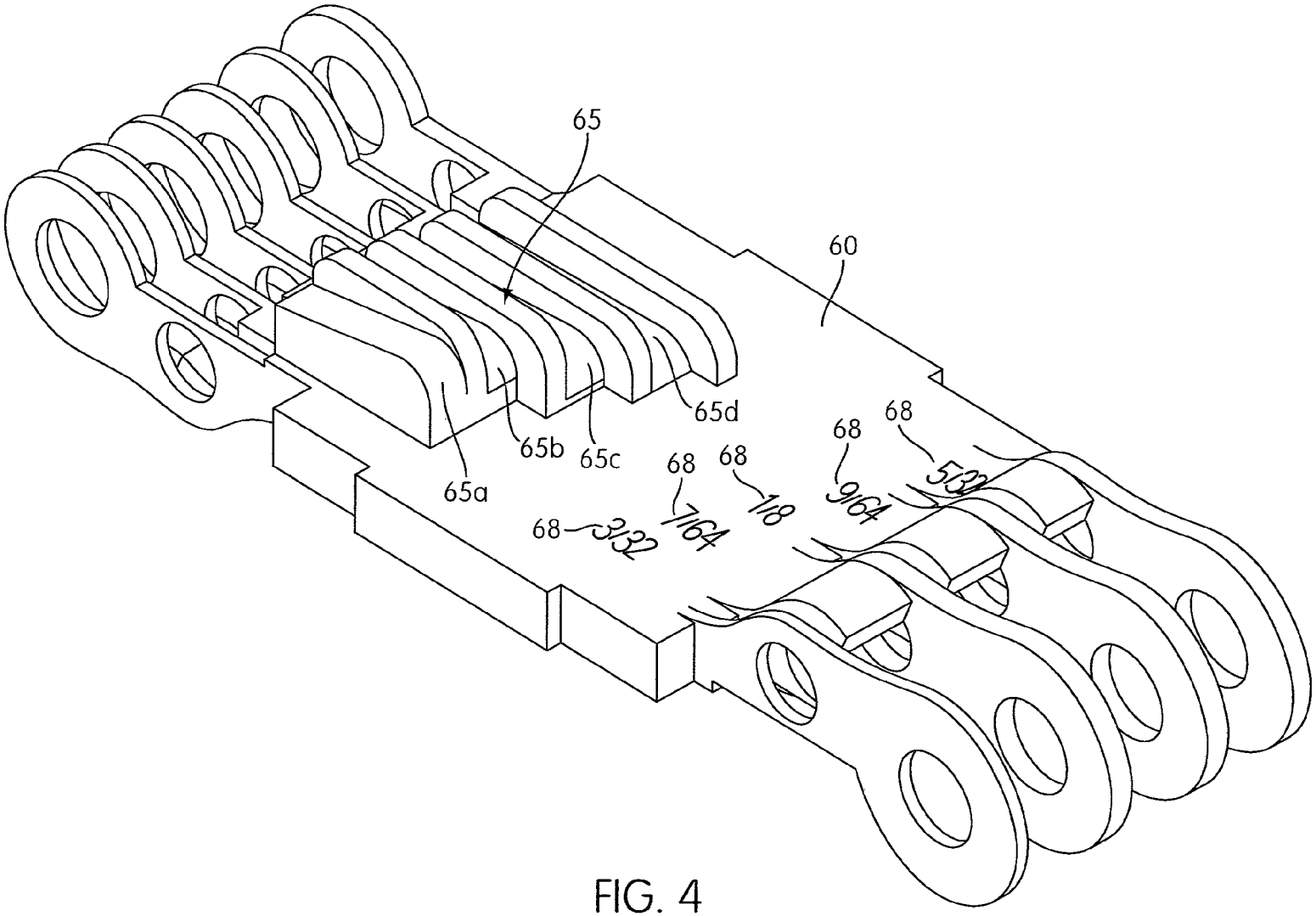
FIG. 4 is an isolated perspective view of the separator and tapered body of FIG. 3.

Turning now to FIG. 4, which shows the separator 60 in isolation, the tapered body 65 may be seen in detail. As shown, the tapered body 65 may comprise a plurality of elements, each of varying size and shape to associate with at least some of the first and second pluralities of work tools 32 and 32'. In an embodiment, the separator 60 may be shaped to comprise the tapered body 65, such that the tapered body 65 is integrally formed on the main separator body 61. In another embodiment, the tapered body 65 may be a separate component mounted to the main separator body 61. In an embodiment, the tapered body 65 may be a single molded element having portions 65*a-e*, each associated with one of the work tools 32*a-e*. In another embodiment, each portion 65*a-e* may be an individual body associated with one of the work tools 32*a-e*. In an embodiment, one or more of the portions 65*a-e* may be omitted. For example, there is no portion 65*e* in the illustrated embodiment, as work tool 32*e* is permitted to contact the main separator body 61 in its closed position.

As seen in the illustrated embodiment, the separator 60 may be configured to identify each of the first and second pluralities of work tools 32 and 32'. In such embodiments, the identifying configuration may be of any suitable form, including but not limited to etchings 68, stickers or other applications. Such identifying marks may be on any suitable portion of the separator 60, such as on the main separator body 61. Such an identifying configuration may be useful, for example when the first and second pluralities of work tools 32 and 32' is of varying sizes or configurations, as described above. For example, where each of the first and second pluralities of work tools 32 and 32' are of different sizes, each of the etchings 68 on the separator 60 may indicate the size of each tool in the first and second pluralities of work tools 32 and 32'. Likewise, where each of the first and second pluralities of work tools 32 and 32' are of a different type, as is described below, the etchings 68 may describe the type of each tool of the first and second pluralities of work tools 32 and 32' that is associated with each etching 68.

Figure 5:
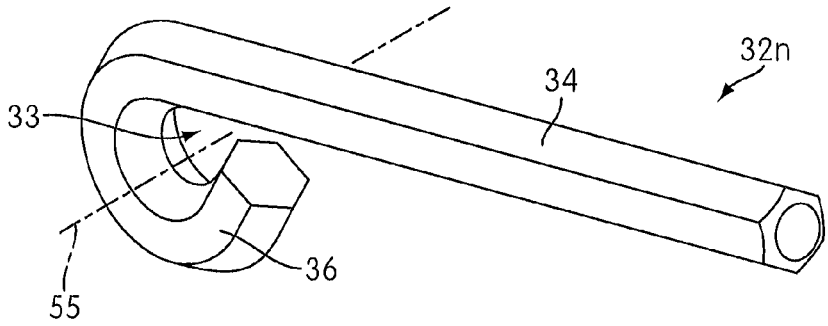
FIG. 5 is an isolated perspective view of an embodiment of a work tool from the present invention.

Seen in FIG. 5 is a non-limiting example of one of the first and second pluralities of work tools 32 and 32', generically referred to as work tool 32*n*. Work tool 32*n* may be representative of any of the work tools 32*a-e* or 32*a*'-c' in the illustrated embodiments, or any other work tool in non-illustrated embodiments. As shown, work tool 32*n* is configured to pivot about pivot axis 55, however work tool 32*n* may alternatively be configured to pivot about pivot axis 55', or any other pivot axis of non-illustrated embodiments. The isolated work tool 32*n* may be of any shape or configuration. As seen in the illustrated embodiment, the work tool 32*n* is a hex key. In other non-limiting embodiments, the work tool 32*n* may be a screwdriver, a wrench, a spanner, a blade, scissors, pliers, a saw, tweezers, a file, a corkscrew, a nut driver, or so on. Additionally, the work tool 32*n* may be of any appropriate size. In an embodiment the work tool 32*n* may be formed from a single, shaped piece of metal having a straight portion 34, bent to form a curved portion 36 around pivot axis 55, creating the receiving hole 33 within which the support 50 may be inserted, and around which the work tool 32*n* may pivot. In other embodiments, the work tool 32*n* may be comprised of multiple bodies, such that, for example, the curved piece 36 is separate from yet is connected to the straight piece 34.

Figure 6:
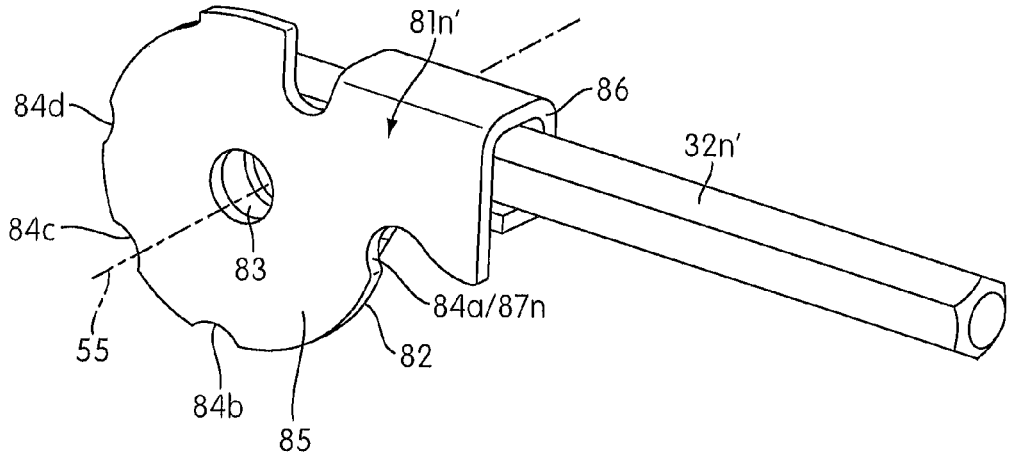
FIG. 6 is an isolated perspective view of the work tool of FIG. 5, associated with a lock engaging member.

FIG. 6 shows the work tool 32*n* as combined with an associated non-limiting example of one of the first or second set of lock engaging members 81', generically referred to as lock engaging member 81*n*. Lock engaging member 81*n* may be representative of any of the lock engaging members 81*a-e* or 81*a*'-c' in the illustrated embodiments, or any other lock engaging member in non-illustrated embodiments. As seen in the non-limiting illustrated embodiment, the lock engaging member 81*n* may comprise a body portion 85 that may generally take a thin cylindrical shape have the receiving hole 83 at its center. Connected or integral to the body portion 85 may be a work tool engaging portion 86 of the lock engaging member 81*n*, that may be configured to at least partially surround a portion of the associated work tool 32*n*, so that both the lock engaging member 81*n* and the work tool 32*n* may pivot about the pivot axis 55 in unison. Alternatively, lock engaging member 81*n* may be configured to pivot about pivot axis 55', or any other pivot axis of non-illustrated embodiments. In the illustrated embodiment, the work tool engaging portion 86 surrounds a portion of the straight piece 34 of the work tool 32*n*. In a non-illustrated embodiment, the lock engaging member 81*n* may alternatively be integral to the work tool 32*n*. In an embodiment wherein the curved piece 36 of the work tool 32*n* is separate from the straight piece 34 the curved piece 36 may comprise the lock engaging member 81*n*.

As seen, an edge of the body portion 85 of the illustrated embodiment may be configured to comprise a substantially arcuate portion 82, which may generally run along a curvature that is a fixed radius away from the pivoting axis 55. Along the substantially arcuate portion 82, there may be a plurality of indentations 84, including illustrated indentations 84*a-d*. In an embodiment, indentation 84*a* may be the same indentation 87*n* corresponding to a stored position for the work tool 32*n*. Each indentation 84 may be arcuate (e.g., concave) in shape, and may correspond to a predetermined locked position. For example, there may be the indentation 84*a* corresponding to a fully stored locked position for the work tool 32*n*. In an embodiment wherein the separator 60 comprises the tapered body 65, the position of the indentation 84*a* corresponding to the fully stored locked position may vary on the substantially arcuate portion 82 for each work tool 32*n*, so that the lock member 90 may lock when each work tool 32*n* is pivoted into its tapered fully closed locked position. In an embodiment there may be an indentation 84*d* corresponding to a fully extended locked position. In an embodiment there may be intermediate indentations 84*b* and 84*c* corresponding to intermediate extended positions for the work tool 32*n*. In other non-illustrated embodiments there may be fewer indentations than those listed, or there may be more indentations corresponding to additional extended positions.

In an embodiment, each locked position is configured to hold the work tool 32*n* to form a corresponding nonzero angle between the housing 20 and the work tool 32*n* at the support 50. In an embodiment, the indentation 84*d* corresponding to a fully extended position may correspond with the work tool 32*n* being locked to form a 180° angle with respect to the orientation of the housing 20. In various embodiments, each of the at least one indentations 84 may correspond to any number of angles, including but not limited to indentation 84*b* forming a 90° angle with respect to the housing 20, and indentation 84*c* forming a 135° angle with respect to the housing 20.

Figure 7:
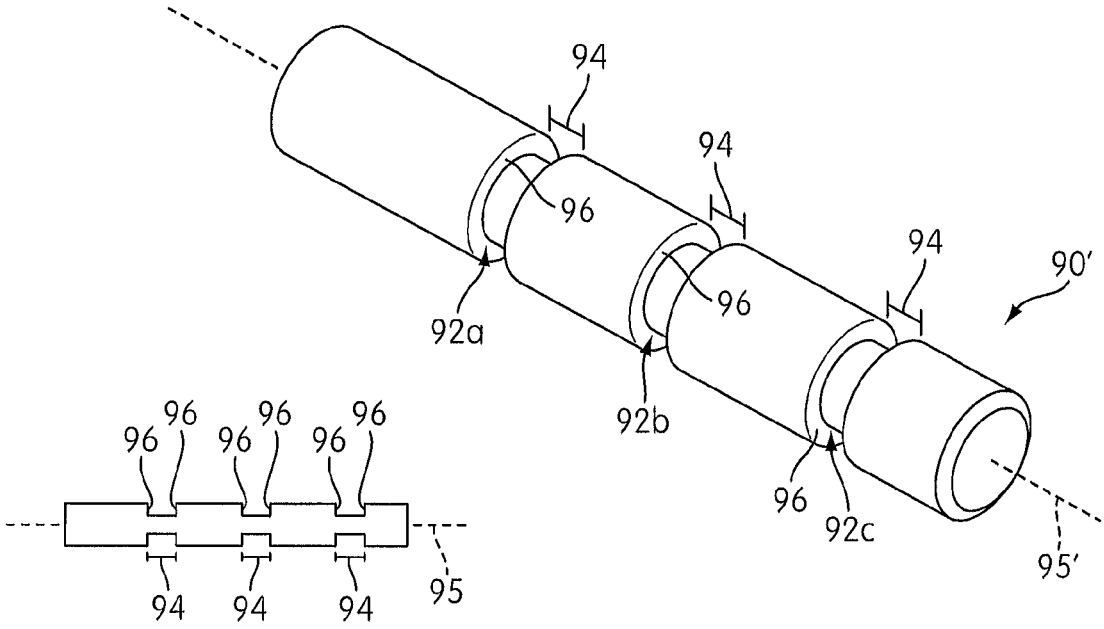
FIG. 7 shows perspective and side views of an embodiment of a lock member of the present invention.

Depicted in isolation in the views of FIG. 7 is an embodiment of the lock member 90. In the illustrated embodiment the lock member 90 is configured to lock and unlock work tools 32*a-c* via their associated lock engaging members 81*a-c*. Like the first and second lock members 90 and 90' in the embodiments depicted above, the lock member 90 of FIG. 7 may be of any construction or configuration, including metal, wood, plastic, or combinations thereof. As seen in the illustrated embodiment, the lock member 90 may comprise a generally cylindrical body. In an embodiment, the lock member 90 may be characterized as a lock pin. In an embodiment, the lock member 90 may be configured to be movable between a respective first position and a second position. In an embodiment, the movement of the lock member 90 may be along the first lock axis 95.

As seen in the illustrated embodiment, the lock member 90 may have a plurality of circumferential grooves 92, individually 92*a*, 92*b*, and 92*c*. The plurality of circumferential grooves 92 may be spaced to correspond with each lock engaging members 81*n* associated with each work tools 32*n*, as they are assembled on the support 50. In an embodiment, the lock member 90 and the circumferential grooves 92 thereof may be formed from an integrally molded structure. In another embodiment, grooves 92 are formed from the removal of toroid shaped portions from a solid generally cylindrical shape forming the lock member 90. In another embodiment, the lock member 90 may be formed by assembling a plurality of cylindrical bodies having a larger radius, interspersed by another plurality of cylindrical bodies having a smaller radius. In an embodiment, each of the circumferential grooves 92 may define a groove width 94. In an embodiment, the groove width 94 may correspond to a width of the substantially arcuate portion 82 of the lock engaging member 81*n*. In an embodiment, the groove width 94 may be no smaller than the width of the substantially arcuate portion 82.

In an embodiment, a difference between the larger and smaller radius formed in the circumferential grooves 92 may define a groove depth 96. In an embodiment, the groove depth 96 may correspond to the shape of each of the indentations 84 (i.e. indentations 84*a-d*) in the lock engaging member 81*n*. As a non-limiting example, where each of the indentations 84 comprises an arc length corresponding to a predefined radius, the predefined radius may approximate the larger radius of the lock member 90. In an embodiment, the distance of the substantially arcuate portion 82 away from the pivot axis 55, the distance of the lock axis 95 away from the pivot axis 55, the radius of the arc length of the indentations 84, and the larger and smaller radiuses of the lock member 90 may be configured so that the lock engaging member 81*n* may pivot about the pivot axis 55 through the circumferential groove 92 when the circumferential groove 92 is aligned with the substantially arcuate portion 82, while the lock member 90 may axially move between the first and second positions when the lock engaging member 81*n* has pivoted such that one of the indentations 84 is positioned to face the lock member 90.

Figure 8:
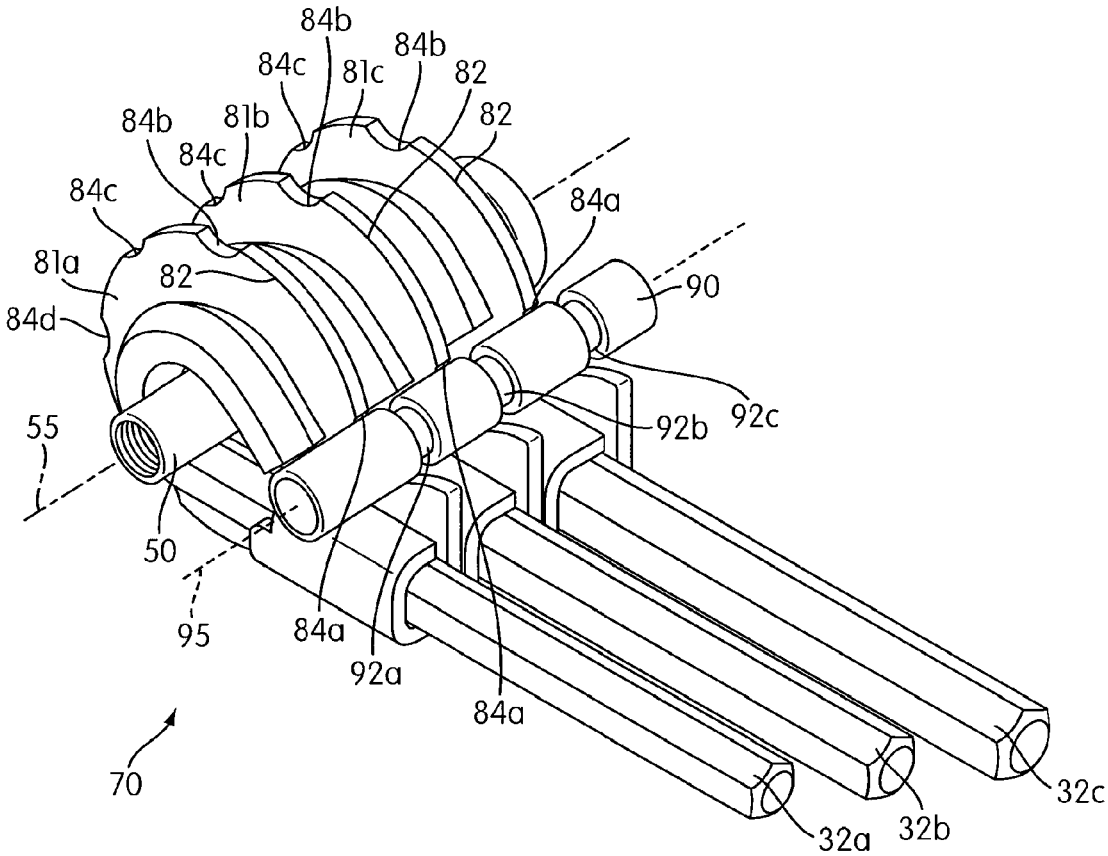
FIG. 8 shows a perspective view of the interaction of the lock member of FIG. 6 with the work tool and lock engaging member of FIG. 7, when the lock member is in a locked position.

An example of this configuration may be seen in FIG. 8, which shows an isolated view of an embodiment of the lock assembly 70 of the present invention, having the work tools 32*a-c* and their associated lock engaging members 81*a-c*, configured to pivot around the pivot axis 55. Also seen in this view is the lock member 90 of FIG. 7 that is configured to be movable between the first position and the second position on the lock axis 95. Although not depicted in the illustrated embodiment, such movement may be accomplished by depressing the push button 100 against the bias from the bias member 110, as is described above. As the illustrated embodiment shows, the lock axis 95 may be spaced from its associated pivot axis 55, so that the lock member 90 may engage with the substantially arcuate portion 82 of each of the lock engaging members 81*a-c*, and the associated indentations 84*a-d*. In an embodiment, the lock member 90 does not apply an axial force to the lock engaging members 81*n* (i.e. the lock engaging members 81*a-c*) at the pivot axis 55. In this context, an axial force at the pivot axis 55 is defined as a force applied by a body at the pivot axis around which the other bodies are pivoting. For example, in this case, there is no force on the lock engaging members 81*a-c* applied by the support 50. In analogy, the lock member 90 is spaced from the through the support 50 at the pivot axis 55.

When the lock member 90 is in the first position (i.e. the locked position it engages the lock engaging members 81*a-c* at one of the indentations 84, such as the indentations corresponding to a fully stored position 84*a*. In this position, the lock member 90 may inhibit the lock engaging members 81*a-c* and their associated work tools 32*a-c* from pivoting about the support 50. For example, the indentations 84*a-d* on the lock engaging members 81*a-c* may be configured to correspond to a radius of the lock member 90 outside of the circumferential grooves 92. In this configuration, the lock engaging members 81*a-c* may be unable to pivot about the support 50 due to the interference between the substantially arcuate portion 82 and the larger radius of the lock member 90 outside of the circumferential grooves 92.

Figure 9:
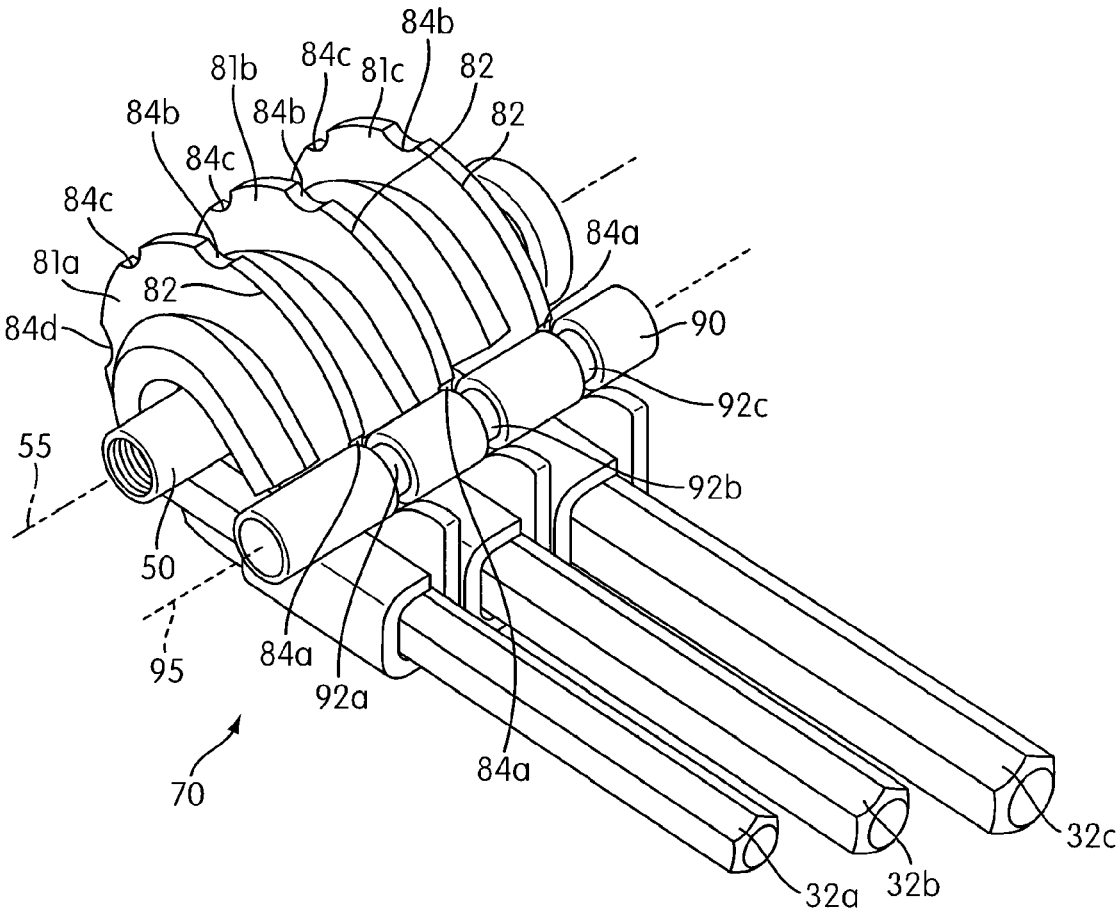
FIG. 9 shows a perspective view of the interaction of the lock member of FIG. 6 with the work tool and lock engaging member of FIG. 7, when the lock member is in an unlocked position.

As is shown in FIG. 9, when the lock member 90 is moved axially along the lock axis 95 into the second position (i.e. the unlocked position), for example by depression of the push button 110 as described above, the lock member 90 may be configured to disengage the lock engaging members 81*a-c* so that the lock engaging members 81*a-c* and their associated work tools 32*a-c* may pivot about the support 50. For example, the axial position on the lock axis 95 when the lock member 90 is in the second position may correspond to the circumferential grooves 92*a-c* being aligned with the substantially arcuate portions 82 of the lock engaging members 81*a-c*, so that the substantially arcuate portions 82 may pivot around the support 50, through the circumferential groove 92, without interference by the lock member 90. In an embodiment, the lock member 90 may be unable to return to the first position on the lock axis 95 while any of the lock engaging members 81*a-c* are pivoting through the circumferential grooves 92, and may only be able to return to the first position when all lock engaging members 81*a-c* have pivoted so that one of the associated indentations 84*a-d* of each of the lock engaging members 81*a-c* has pivoted to face the circumferential grooves 91*a-c* of lock member 90. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the'extent possible, one or more features of any embodiment can be combined with one or more features of any other embodiment.

What is claimed is:

1. A folding tool comprising:

a housing having a pair of sidewalls in spaced relation to each other;

a support extending transversely between the pair of sidewalls;

a plurality of work tools pivotally supported by the support, the support defining a pivot axis for the work tools, each work tool having an associated lock engaging member;

a lock member movable along a lock axis between a first position and a second position, wherein when the lock member is in the first position, it is positioned to engage the lock engaging members during attempted pivoting of the work tools so that the work tools are inhibited from pivoting about the support, and wherein when the lock member is in the second position, it is positioned to disengage from the lock engaging members during attempted pivoting of the work tools so that the work tools may pivot are pivotable about the support; and a gap being defined between the lock engaging member and the lock member such that the lock member does not apply an axial force along the lock axis to the lock engaging members when the lock member is in the first position and the second position.

2. The folding tool of claim 1, wherein each of the plurality of work tools are selected from the group consisting of: a hex key, a screwdriver, a wrench, a spanner, a blade, scissors, pliers, a saw, tweezers, a file, a corkscrew, and a nut driver.

3. The folding tool of claim 1, further comprising:

a second support extending transversely between the pair of sidewalls;

a second lock member movable between a first position and a second position;

wherein the plurality of work tools and associated lock engaging members are distributed between being pivotable about the support and being pivotable about the second support, the second support defining a second pivot axis for the work tools that are configured to pivot about the second support;

wherein when the second lock member is in the first position, it engages the lock engaging members so that each of the work tools that are pivotable about the second support are inhibited from pivoting about the second support, and wherein when the lock member is in the second position, it disengages the lock engaging members so that the work tools that are pivotable about the second support are pivotable about the second support; and wherein the second lock member does not apply an axial force to the lock engaging members.

4. The folding tool of claim 1, further comprising a bias member configured to bias the lock member to the first position.

5. The folding tool of claim 4, wherein the bias member comprises a spring.

6. The folding tool of claim 5, further comprising a push button at an end of the lock member, wherein the spring is located at an end of the lock member opposite to the push button, wherein pressing the push button causes a compression of the spring.

7. The folding tool of claim 1, wherein each of the lock engaging members have a plurality of locked positions configured to hold the work tool to form a corresponding nonzero angle between the housing and the work tool at the support.

8. The folding tool of claim 7, wherein each of the lock engaging members comprises a substantially arcuate surface having a plurality of indentations, each indentation configured to correspond to one of the plurality of locked positions.

9. The folding tool of claim 8, wherein the lock member comprises a cylindrical body having a plurality of circumferential grooves, wherein each of the circumferential grooves are configured to align with the substantially arcuate surface of a corresponding one of the lock engaging members when the lock member is in the second position, permitting the lock engaging member to pivot about the support by pivoting through the circumferential groove.

10. The folding tool of claim 9, wherein each indentation of each lock engaging member is configured to permit the lock member to move between the first position and the second position, locking the lock engaging member in a corresponding one of the plurality of locked positions when the lock member is in the first position.

11. The folding tool of claim 1, further comprising a separator configured to lift some of the plurality of work tools to different orientations when the plurality of work tools are stored within the housing.

12. A folding tool comprising:

a housing having a pair of sidewalls in spaced relation to each other;

a support extending transversely between the pair of sidewalls;

a plurality of work tools pivotally supported by the support, the support defining a pivot axis for the work tools, each work tool having an associated lock engaging member; and a lock member movable between a first position and a second position, wherein when the lock member is in the first position, it engages the lock engaging members so that the work tools are inhibited from pivoting about the support, and wherein when the lock member is in the second position, it disengages the lock engaging members so that the work tools are pivotable about the support;

wherein each of the lock engaging members have a plurality of locked positions configured to, hold the work tool to form a corresponding nonzero angle between the housing and the work tool at the support; and wherein each of the lock engaging members comprises a substantially arcuate surface having a plurality of indentations, each indentation configured to correspond to one of the plurality of locked positions.

13. The folding tool of claim 12, wherein each of the plurality of work tools are selected from the group consisting of: a hex key, a screwdriver, a wrench, a spanner, a blade, scissors, pliers, a saw, tweezers, a file, a corkscrew, and a nut driver.

14. The folding tool of claim 12, further comprising:

a second support extending transversely between the pair of sidewalls;

a second lock member movable between a first position and a second position;

wherein the plurality of work tools and associated lock engaging members are distributed between being pivotable about the support and being pivotable about the second support, the second support defining a second pivot axis for the work tools that are configured to pivot about the second support;

wherein when the second lock member is in the first position, it engages the lock engaging members so that each of the work tools that are pivotable about the second support are inhibited from pivoting about the second support, and wherein when the lock member is in the second position, it disengages the lock engaging members so that the work tools that are pivotable about the second support are pivotable about the second support; and wherein the second lock member is axially movable about an axis that is spaced from the second pivot axis.

15. The folding tool of claim 12, further comprising a bias member configured to bias the lock member to the first position.

16. The folding tool of claim 15, wherein the bias member comprises a spring.

17. The folding tool of claim 16, further comprising a push button at an end of the lock member, wherein the bias member is located at an end of the lock member opposite to the push button, wherein pressing the push button causes a compression of the spring.

18. The folding tool of claim 12, wherein the lock member comprises a cylindrical body having a plurality of circumferential grooves, wherein each of the circumferential grooves are configured to align with the substantially arcuate surface portion of a corresponding one of the lock engaging members when the lock member is in the second position, permitting the lock engaging member to pivot about the support by pivoting through the circumferential groove.

19. The folding tool of claim 18, wherein each indentation of each lock engaging member is configured to permit the lock member to move between the first position and the second position, locking the lock engaging member in a corresponding one of the plurality of locked positions when the lock member is in the first position.

20. The folding tool of claim 12, further comprising a separator configured to lift some of the plurality of work tools to different orientations when the plurality of work tools are stored within the housing.

21. A folding tool comprising:

a housing having a pair of sidewalls in spaced relation to each other;

a support extending transversely between the pair of sidewalls;

a plurality of work tools pivotally supported by the support, the support defining a pivot axis for the work tools, each work tool having an associated lock engaging member;

a lock member movable along a lock axis between a first position and a second position, wherein when the lock member is in the first position, it is positioned to engage the lock engaging members during attempted pivoting of the work tools so that the work tools are inhibited from pivoting about the support, and wherein when the lock member is in the second position, it is positioned to disengage from the lock engaging members during attempted pivoting of the work tools so that the work tools may pivot about the support; and a gap being defined between the lock engaging member and the lock member such that an axial force applied to the work tools along the lock axis is substantially constant regardless of whether the lock member is in the first position or the second position.

22. The folding tool of claim 21, wherein each of the plurality of work tools are selected from the group consisting of: a hex key, a screwdriver, a wrench, a spanner, a blade, scissors pliers, a saw, tweezers, a file, a corkscrew, and a nut driver.

23. The folding tool of claim 21, further comprising:

a second support extending transversely between the pair of sidewalls;

a second lock member movable between a first position and a second position;

wherein the plurality of work tools and associated lock engaging members are distributed between being pivotable about the support and being pivotable about the second support, the second support defining a second pivot axis for the work tools that are configured to pivot about the second support;

wherein when the second lock member is in the first position, it engages the lock engaging members so that each of the work tools that are pivotable about the second support are inhibited from pivoting about the second support, and wherein when the lock member is in the second position, it disengages the lock engaging members so that the work tools that are pivotable about the second support are pivotable about the second support; and wherein an axial force between the work tools is substantially constant regardless of whether the second lock member is in the first position or the second position.

24. The folding tool of claim 21, further comprising a bias member configured to bias the lock member to the first position.

25. The folding tool of claim 24, wherein the bias member comprises a spring.

26. The folding tool of claim 25, further comprising a push button at an end of the lock member, wherein the bias member is located at an end of the lock member opposite to the push button, wherein pressing the push button causes a compression of the spring.

27. The folding tool of claim 21, wherein each of the lock engaging members have a plurality of locked positions configured to hold the work tool to form a corresponding nonzero angle between the housing and the work tool at the support.

28. The folding tool of claim 27, wherein each of the lock engaging members comprises a substantially arcuate surface having a plurality of indentations, each indentation configured to correspond to one of the, plurality of locked positions.

29. The folding tool of claim 28, wherein the lock member comprises a cylindrical body having a plurality of circumferential grooves, wherein each of the circumferential grooves are configured to align with the substantially arcuate surface of a corresponding one of the lock engaging members when the lock member is in the second position, permitting the lock engaging member to pivot about the support by pivoting through the circumferential groove.

30. The folding tool of claim 29, wherein each indentation of each lock engaging member is configured to permit the lock member to move between the first position and the second position, locking the lock engaging member in a corresponding one of the plurality of locked positions when the lock member is in the first position.

31. The folding tool of claim 21, further comprising a separator body configured to lift some of the plurality of work tools to different orientations when the plurality of work tools are stored within the housing.

* * * * *